US008011163B2

(12) United States Patent
Bazzano

(10) Patent No.: US 8,011,163 B2
(45) Date of Patent: Sep. 6, 2011

(54) METHODS AND APPARATUS FOR LAYING MARBLE TILE FLOORING

(76) Inventor: Sebastian Bazzano, Loxahatchee, FL (US)

( * ) Notice: Subject to any disclaimer, the term of this patent is extended or adjusted under 35 U.S.C. 154(b) by 178 days.

(21) Appl. No.: 11/983,978

(22) Filed: Nov. 13, 2007

(65) Prior Publication Data

US 2009/0120032 A1 May 14, 2009

(51) Int. Cl.
*E04B 1/00* (2006.01)

(52) U.S. Cl. ..... 52/747.11; 52/749.11

(58) Field of Classification Search ..... 52/747.11, 52/747.12, 749.1, 749.11
See application file for complete search history.

(56) References Cited

U.S. PATENT DOCUMENTS 3,375,633 A * 4/1968 Pourtau ..... 52/749.11
4,712,309 A * 12/1987 Kingston et al. ..... 33/527
4,893,451 A * 1/1990 Valente ..... 52/749.11
5,768,793 A * 6/1998 Fields ..... 33/526
5,807,022 A * 9/1998 McCleary ..... 404/97
5,867,965 A * 2/1999 Pilz et al. ..... 52/749.1
6,047,520 A * 4/2000 Caraballo ..... 52/749.11
6,412,185 B1 * 7/2002 Mills et al. ..... 33/526

* cited by examiner

*Primary Examiner* — Eileen Lillis
*Assistant Examiner* — Branon C Painter
(74) *Attorney, Agent, or Firm* — R M Saccocio, PA

(57) ABSTRACT

Methods and apparatus for laying marble tile flooring utilizes a form and method for using the form. The form provides for applying layers of a sealant, mud and thin set to a height determined by the form for laying the first tile in a horizontally level position. Second and subsequent tiles are laid relative to the first laid tile by gauging off the first laid tile and fixing the height of sealant, mud, and thin set such that the second and subsequently laid tiles are level with the first tile and parallel to the edges of the first laid tile. The result is a completely horizontal tiled floor with each tile level to an adjacent tile and parallel and or perpendicular relative to each other tile.

10 Claims, 2 Drawing Sheets

METHODS AND APPARATUS FOR LAYING MARBLE TILE FLOORING

BACKGROUND OF THE INVENTION

1. Field of the Invention

This invention relates in general to the field of laying and setting marble, stone, ceramic, porcelain or other such materials or tiles on floors and in particular to methods and apparatus setting and laying marble tiles or other natural stone of any type, on a floor using relatively unskilled tile layers and producing a finished floor is less time and with greater accuracy.

2. Description of the Prior Art

Marble tile flooring is perhaps the most beautiful, diversified, and costly type of flooring that can be laid in homes, hotels offices, exhibition halls and any other place where a premium floor is desired. Marble tile, is of course a natural product found in many different parts of the world. The variations are numerous, even from the same quarry. The physical properties of marble tile are likewise varied, some are soft, some are hard, some are very fragile being subject to cracking along natural lines. The latter type are sometimes reinforced with a mesh backing.

There are other types of natural stone flooring such as coral, limestone, granite and the like. These like marble tiles have different physical properties and of course present a different effect when installed. One problem that exists with natural flooring products of the type described is the consistency of the thickness and squareness of the tiles in that they are cut from slabs and mechanically finished (In lieu of ceramic tiles which are usually cast from a powered or liquid material and then fired for hardness. Ceramic tiles are usually of a more consistent in thickness but vary in flatness and squareness due to the vagaries of firing the raw product.)

The laying and setting of natural floor tiles of any type, including but not limited to marble tile and other natural stone products or tiles, (hereinafter collectively referred to as "marble tiles") that have been made into squares, rectangles or other geometric shapes intended for flooring requires precision and very time consuming labor due primarily to the above mentioned physical variations. Other factors also come into play, for example, the base, floor or sub surface on which the marble tile is to be laid must be very level or flat. A non flat surface can result in cracking of the marble tile after it is permanently laid, and of course variations in the flatness of the finished flooring results in an unfavorable aesthetic effect. One prior art solution is to achieve a flat subsurface is by first laying a type of cement backer board on the entire floor. Another type of prior art solution is to attempt to grind the floor to achieve the required degree of flatness. However, the most common prior art method of achieving a level sub floor is to use a relatively thick base usually comprising a layer of adhesive material, a layer of cement based material (known in the trade as "mud") under each tile and another layer of adhesive material. The adhesive material is usually a product known in the industry as "thin set" which includes cement, sometimes sand, and additives so that a strong bond is achieved between the stone and the mud, and between the mud and the floor. The thick layer of mud is necessary to assure a level floor and to serve as a platform for contraction and expansion and long time stability. The layer of mud can often be between one to three inches in thickness on any given subsurface, which mud is then compressed to a degree necessary such that the upper surface each adjacent tile lies in substantially the same plane. The layers of the thin set are usually about one eight of an inch each. Thus, because floors are not perfectly flat and level and the tiles themselves can vary in thickness, the thickness of the mud necessarily varies in order to assure that the finished stone surfacing is level and flat. For purposes of the description that follows, the combination of the thin set, adhesive, additives, and mud will simply be termed "mud" hereinafter.

In view of the above aspects of marble tile flooring that require or advantageously use a mud base, in the past, a great amount of experience, skill and, know how is required to know how much mud to use at any given sub floor location so that the resulting flooring has taken into account the level variations of the sub floor. Then too, a great amount of time is required to lay and set each adjacent piece of tile or stone so that each piece is perfectly level, flat and aligned with all of the other marble tile tiles or stones making up the finished flooring. In the past then, it is understandable that experienced and extremely time consuming hand labor is involved in laying and setting marble tile flooring. A floor extending over a large area compounds the time and experience and costs needed to achieve a substantially level and aligned marble tile floor.

Thus, there exists the need for methods and apparatus to accomplish efficient but proper laying and setting of marble tile flooring having a mud base without the skill, experience, know how, and hand labor previously required. The present invention fulfills this need.

SUMMARY OF THE INVENTION

The above-stated objects as well as other objects which, although not specifically stated, but are intended to be included within the scope of the present invention, are accomplished by the present invention and will become apparent from the hereinafter set forth Detailed Description of the Invention, Drawings, and the Claims appended herewith.

The present invention comprises methods and apparatus that will allow for precise laying and setting marble tile flooring using a mud base in substantially less time than the prior art hand laying and setting. Moreover, the method allows for lesser-experienced stone and tile setters to accomplish the quality of much more experienced stone and tile setters, in less time, and with less costs.

The method comprises selecting a starting place that can be either the lowest or highest place of the subsurface, or any other appropriate location, such that each adjacent marble tile, and accordingly, the entire floor can comprise one flat and level surface when all of the marble tiles are laid. For example, and only for purposes of describing the inventive method and apparatus, it will be assumed that the marble tile is of equal side dimensions, i.e., square and at right angles to each other. The thickness of the marble tile may vary slightly from piece to piece and the subsurface will not be level. The first marble tile is then carefully laid with the use of a unique form such that the upper surface is horizontal and the sides are aligned as desired. The form used with the inventive method is then placed to a location immediately adjacent the first laid tile. Adjusting screws on one side of the form are set to the height of the first laid marble tile. Adjusting screws on other sides of the form are adjusted to the sub floor surface and further adjusted to position the form perfectly horizontal and at a height that is one tile thickness less than the first marble tile. An appropriate amount of mud and the thin set is applied within and to the top of the form. The form is lifted, a second marble tile is laid on the mud and adjusted to be perfectly level and horizontal with the first tile. This procedure is continued until the entire floor is laid.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
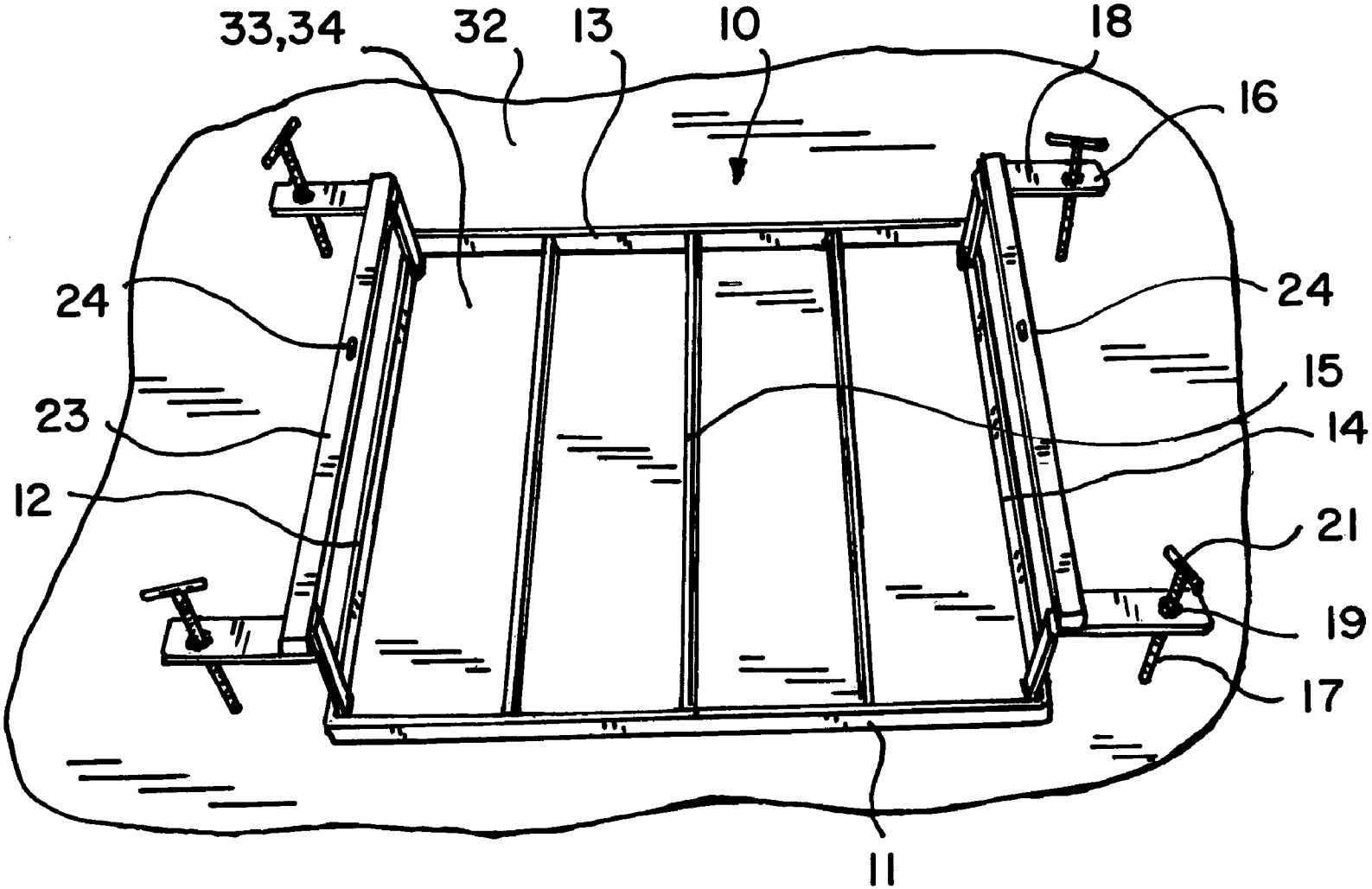
FIG. 1 is an isometric rendering of one embodiment of the form used with the inventive method, including the laying and setting of the first laid marble tile.

As required, detailed embodiments of the present invention are disclosed herein; however, it is to be understood that the disclosed embodiments are merely exemplary of the invention, which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure. Additionally, the verbiage used herein is intended to better enable a person to understand the invention and therefore, such verbiage is not to be interpreted as limiting the invention.

Reference is now made to the drawings, wherein like characteristics and features of the present invention shown in the various figures are designated by the same reference numerals.

The inventive marble tile laying and setting method is based on the time honored principle of substantially setting a first marble tile with its upper surface horizontal and the sides in alignment with a predetermined arrangement, and then using the setting of the first marble tile and the flooring subsurface to sequentially lay succeeding marble tiles. In this manner, the unevenness of the flooring subsurface is negated and the entire marble tile floor is substantially horizontal and level and perfectly aligned. In the prior art these activities were accomplished manually by very skilled workers and consumed a considerable amount of time. The inventive method accomplishes this highly desirable effect more precisely, in less time, and for less costs than the prior art method with the additional advantage of not having to use highly skilled workers.

In association with practicing the inventive method, a unique form is used to help establish the necessary level of the sub floor, the top of the mud composition, the level of the finished marble, and the alignment of the tiles. One embodiment of a satisfactory form is depicted in FIG. 1. In this embodiment, the form 10 includes four side members 11-14, each comprising a bar made of metal or other appropriate material, having a length substantially equal to the side length of the marble tile or stone tile being laid. Thus, if the tile is square, the length of each side is the same; if the tile is rectangular, the length of each side corresponds to the respective side of the rectangular tile. The overall length and width of the form 10 can be smaller than that of the tile and still allow the inventive method. The thickness of each bar 11-14 can be of the order of ½ to 1 inch. The height of the bars 11-14 can be less than the thickness of the mud to be applied but can not be more than the thickness of the mud to be applied. The side members can be conventionally joined at their ends, such as by welding. It is preferable that the top and bottom surfaces of the sides 11-14 lie in separate but parallel planes and be flat when resting on a flat surface.

Preferably one or more intermediate bar members 15 are attached across one pair of opposite sidebars, such as 11 and 13. Intermediate bars 15 can have the same height and thickness of sidebars 11-14. In the example shown, each of one set of opposite sides, such as 12 and 14, include two or more leveling members 16, each comprising a vertical member 17, an outwardly extending horizontal member 18, and a height adjusting screw member 19. The dimensions, verticalness, horizontalness, and squareness of each individual leveling member 16 need not be exact, even relative to each other.

Leveling members 16 are preferably oriented and spaced more toward the ends of bars 12 and 14 so as to have a relative large "foot print". By way of an example only, if bars 12 and 14 are 18 inches long, each leveling member 16 can be positioned about 2 inches from the ends of each bar, thusly leaving a space of about 14 inches between the leveling members 16 on each of bars 12 and 14.

The vertical bars 17 can be about 2 to 4 inches in vertical height. The horizontal bars 18 can extend outwardly about 6 inches. These dimensions are very approximate. The leveling screw 19 is threadingly connected to horizontal bar 18 approximately 1 inch from the end of the horizontal bar 15 and oriented in a generally vertical direction. Leveling screws can comprise an elongated screw member having a turning member 21 permanently attached to the top of the screw member so as to allow for adjustment of the length of the screw member below the horizontal bar 18. An adjustable thumbnut 22, or the equivalent, is threadingly attached to the screw member and located between the turning member 21 and the top of the horizontal bar 18. The adjustable thumbnut 22 provides for temporally but fixedly securing the length of the leveling screw below the level of the horizontal bar 18. The leveling screw 16 can have a swivel foot at the bottom thereof, or simply end without a swivel foot. Thus, each leveling screw 16 is independently adjustable relative to the other leveling screws 16, by simply turning the turning member 21 and securing its position by tightening the adjustable thumbnut 22 against the top of the horizontal bar 18.

The embodiment of the form 10 shown in FIG. 1 includes another horizontal cross bar 23 extending across the horizontal members 18 of the leveling screws 16. The horizontal cross bars 23 serve the purpose of providing lifting apparatus to the form 10. The location of the cross bars 23 allow a space between the sides 12 and 14 and the respective cross bar 23. The function of this space is more fully described hereinafter.

An additional feature of the form 10 can include one or more horizontal level indicating devices 24, such as a bubble level, placed on top of the bars 23. It is preferable that the leveling devices 24 should at least indicate levels in two horizontal directions generally perpendicular to each other along the plane of the cross bars 23. In lieu of the bubble levels, conventional box levels can be used.

In another embodiment, the stone and tile setting apparatus 10 can be made to have an adjustable length or width, or both, so that one device can accommodate tiles of different sizes. One method to make the bars 11 and 12 adjustable in length comprises a conventional tongue and groove arrangement or a conventional lap joint connection. However, in accordance with the relative simplicity of the construction of form 10, it is preferable that new forms 10 are constructed for each size of tile to be laid.

The following inventive method can be used with the aid of the form 10 or its equivalent in the laying and setting of the first marble tile 31 and the entire marble floor.

Figure 2:
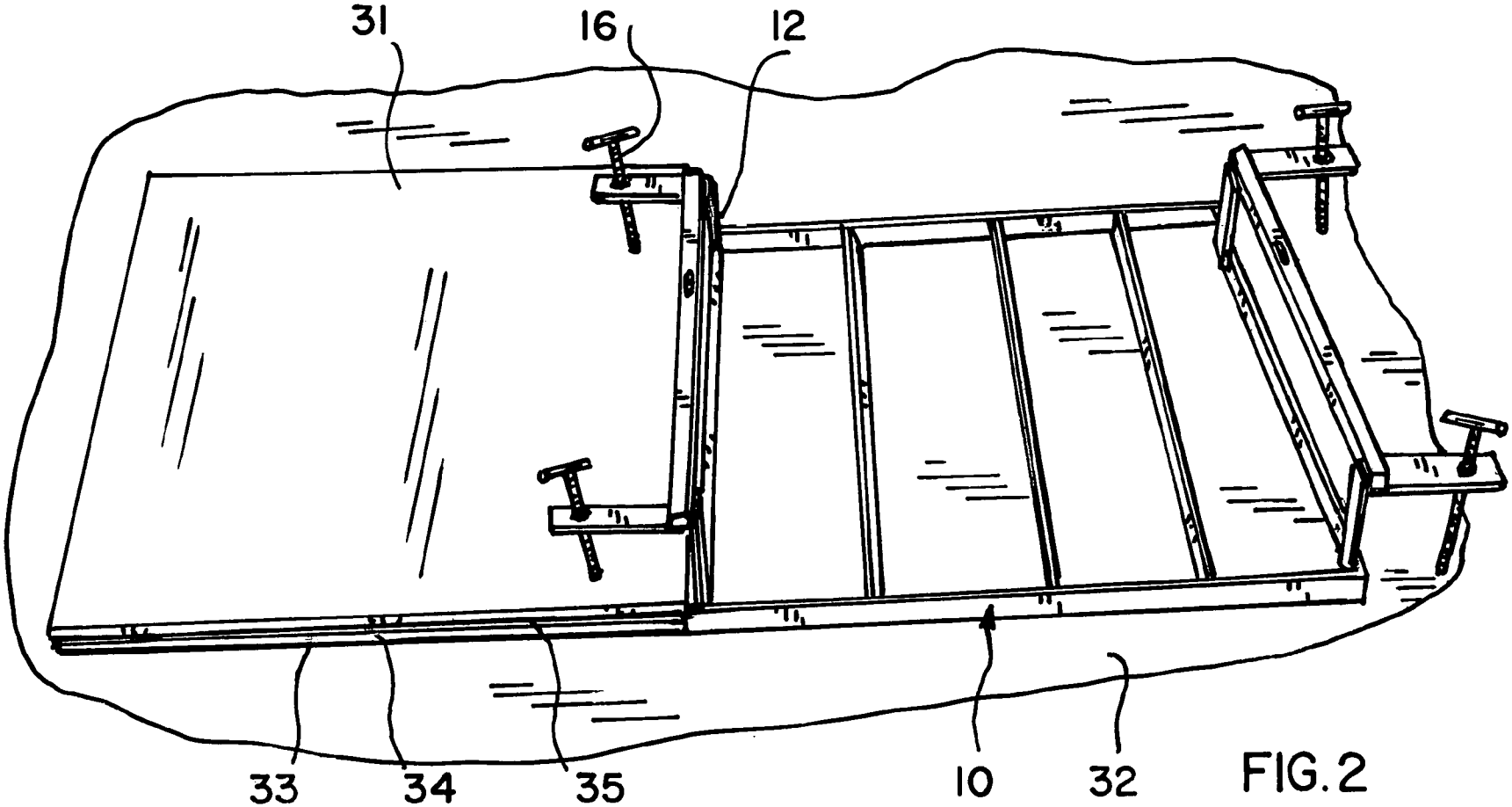
FIG. 2 is an isometric view of the inventive method and the form used therewith in applying the mud to a second and subsequent marble tile locations.

Since the sub floor will most likely not be level, a determination is made of the amount of unevenness of the sub floor. This determination is necessary to establish the finished height of the marble tiles whereby all the tiles are level relative to each other and thus a level marble floor is the result. Thus, standard industry practice, including the inventive method, involves a preliminary study of the sub floor 32 to determine variations in levels, slopes, and any other non flat, non even, or non level discrepancies in the sub floor. The location of the first marble tile 31 (see FIG. 2) to be laid and set is determined in accordance with standard industry practice. For example, this may be at the location of the lowest level of the sub floor, or if another location is to be used for the first marble tile, the difference in height at this location relative to the lowest location is determined. The angular orientation of the first marble tile 31 location as regards the lineal direction of the sides of the marble tile 31 along the floor is also determined in accordance with standard industry practices. In accordance with the determined location and orientation of the first marble tile 31 a grid can be marked on the floor 32 indicating the location and orientation of the totality of the marble tiles to be laid and set on the floor. Any other acceptable and known method of laying out the grid on the floor can also be used to indicate the location and orientation of the marble tiles.

For a properly finished marble tile floor the level discrepancies are normally adjusted for by varying the thickness of the mud where necessary. However, prior to the present inventive method, the tile setter had to rely on his expertise and experience to individually determine the amount of mud to be used with the laying of the first marble tile and each successive tile for the entire floor. Accordingly and necessarily, since the prior art procedure of the amount of mud to be used for each individual tile was determined by the expertise of the tile setter, such prior art procedure is non exact and often required adjustments as the flooring progressed in order to eliminate even slight mistakes in the determination of the amount of mud to use for each tile. Moreover, because different tile experts having different degrees of expertise often work on the same job as well as on different jobs, in general, in the prior art, there exist varying degrees of the levelness and the consistency of the same of a well finished marble floor. This is not to say that all prior art procedures resulted in a less than desirable finished floor. Indeed, since the prior art method of laying marble tile is an art, there are very experienced marble tile laying craftsmen who have the ability to provide a substantially well finished and level floor. But the same requires special talent and careful attention to any discrepancies that would affect a well finished marble tile floor that is level, stable and not subject to cracking after a period of use. Of course, the same also involves a great amount of time and costs. In the inventive method, the expertise of the tile setter in determining the amount of mud to be used with each individual marble tile is removed as a factor such that the proper amount of mud is automatically applied resulting in consistently level marble floors.

Preferably, with the inventive procedure (as in the prior art), a thin layer of thin set 33 is applied to the floor at the location of the first marble tile 31 to be laid for the purpose explained above. In the inventive method, the form 10 is carefully placed on the floor at the determined location, over the applied coating of thin set. (See FIG. 1.) The form 10 is further precisely placed over the first marble tile location making certain that the side members 11-14 are accurately aligned lengthwise with the determined grid. The form 10 is then adjusted by means of the leveling devices 16 so that the top surfaces of the bars 11-14 are precisely aligned and leveled with the previously determined finished height of the tiled floor (at this particular location) minus the thickness of the marble 31. The bubble levels 24, if provided, will indicate when the leveling procedure is correct. In lieu of the bubble levels, standard box levels can be used.

It is well known that the laying and setting of the first marble tile is extremely important in that the laying and setting of all of the remaining stones or tiles are set relative to the first marble tile. Thus, if the first marble tile is incorrectly laid and set, it is possible that the entire finished floor will be unacceptable. The level adjustability of the form 10 and the procedure used as described hereinafter provides the assurance that the first and all other marble tile tiles will be properly laid and set.

Once the form 10 is accurately oriented and its height properly set and leveled, the aforementioned mud 34 is applied to the openings between the bars 11-14 and filled to somewhat more than the level of the top of the bars 11-14. It is to be noted that the bottom surfaces of the bars 11-14 will not necessarily rest on or be in contact with the sub floor. The mud 34 is then troweled such that the mud 34 is at the level of each bar 11-14 and any intermediate cross bars 15. The space between the bars 12 and 14 and the respective horizontal bars 23 provides sufficient clearance for the trowel to pass under the horizontal bars 23 and level the mud to the height of sides 12 and 14. This feature of the inventive method allows the mud 34 to be troweled to the proper level relative to all sides and cross bars of the form 10 by providing access to the top surface of the sides and cross bars.

The first marble tile 31 is then preferably layered with a thin coating of thin set 35 as above described on its bottom surface and set aside. The form 10 is carefully lifted off the floor, using the horizontal bars 23 as gripping members, leaving behind the exact amount of mud required to properly set the first marble tile. Moreover, when the form 10 is lifted, spaces are created in the mud by the previous presence of cross bars 15 and side bars 11-14. The set aside first marble tile is then carefully laid over the mud with the sides of the tile aligned with the grid. If desired, the aforementioned layer of thin set can be applied just prior to setting the marble tile 31 onto the mud 34. Pressure is applied to the top surface of the tile 31 to assure proper contact and adhesion between the mud 34 and layers of thin set. The spaces created in the mud by the bars 15 and the side bars 11-14 now serve to allow the aforesaid applied pressure to make positive contact with the mud and if necessary, to further account for any unevenness in the mud 34 by forcing the mud into the spaces created by the cross bars 15 and the side bars 11-14. Final adjustments, if required, are then made to the laid and set first marble tile 31 which final adjustments are again provided for by the spaces created in the mud. It is to noted that the marble tile 31 extends approximately to the outer edges of the side bars 11-14. Thus, when the form 10 is lifted, spaces in the mud exist around and under the entire periphery of the marble tile 31. Without the spaces in the mud, the pressure applied to the marble tile would necessarily force mud out of the sides of the tile which then must be completely removed in order to prevent it from interfering with the proper spacing between adjacent tiles. Moreover, without the spaces created by the cross bars 15, a greater amount of carefully applied pressure would be required to force the mud from the center of the tile to its outer sides. Such greater pressure and where it is applied can easily upset the overall levelness of the tile. With the inventive method the multitude of spaces in the mud requires less pressure because the mud does not need to travel the entire length and width of the marble tile.

Even further, without the created spaces, including but not limited to the peripheral space under the marble tile 31, excess mud could be forced up between adjacent stones or tiles resulting in uncontrolled and undesired spaces between adjacent stones or tiles and adversely affect the grid alignment of the laid and set stones or tiles. While a more experienced marble tile setter might account for these adverse effects by knowing how much and where to place the mud, the inventive method allows a lesser experienced marble tile setter not having this knowledge or know how to accomplish the same corrective measures with a great deal of consistency.

Once the first marble tile 31 is laid and set, the inventive method can then be used to lay and set the remaining marble tiles. Now also see FIG. 2 which depicts the use of the first laid marble tile 31 and the form 10 being used in preparation to lay and set a second marble tile. The height of the leveling screws 16 on one side (for example side 12, both of which leveling screws were previously positioned at the sub floor level less the thickness of the marble tile 31) of the form 10 are raised slightly above the level of the top of the first laid and set marble tile 31. The opposite set of leveling devices 16 on side 14 are left at the previously set sub floor level. The form 10 is then positioned with side 12 positioned against one side of the first laid marble tile 31, or at a small desired or predetermined distance therefrom and in line with the previously established grid pattern. Each of the leveling screws 16 on side 12 are lowered to the top of the first laid marble tile and backed off by the thickness of the marble tile. The opposite set of leveling screws, in this example attached to side 14 are resting on the sub floor 32. The horizontal levelness of the sides 11-14 are checked for being level in all directions. Since the first laid marble tile was previously set to be perfectly level, the new setting of the level screws 16 having been established from the first laid tile 13, should result in all sides 11-14 of form 10 being level or very close to being level. However, should it be determined that the side bars 11-14 are not perfectly level, a further adjustment to the level screws on side 12 is in order. Minor adjustments of the leveling screws 16 on side 14 may also be necessary. Again, the bottom surfaces of sides 11-14 will not necessarily be in contact with the sub floor 32.

Once the levelness is accomplished, mud is applied to the form 10 bounded by sides 11-14 and as previously stated, slightly above the top surfaces of side bars 11-14 and cross bars 15. Again as previously, the excess mud is removed by a trowel. The form 10 is carefully lifted and a second marble tile is placed on the mud. Pressure is evenly applied to the second marble tile to bring it to the same level as the first laid marble tile. The spaces in the mud again allow for the pressure to lower and adjust the second marble tile. This procedure is repeated until all of the marble tiles have been laid and set.

Should it be determined when laying the second marble tile it is not possible to apply only a reasonable amount of pressure to bring the second marble tile in horizontal alignment with the first laid marble tile, simple adjustments can be made to the leveling screws. For example, the leveling screws associated with side 11 can be each be unturned (or backed off) one complete turn. The leveling screws on side 14 would also have to similarly unturned to again bring all four sides 11-14 level to each other. This would cause the form 10 to be lowered relative to the sub floor by the pitch of one turn of the screw. The resulting excess mud over the top surfaces of sides 11-14 would again be trowled off; the form 10 would again be lifted; the second tile replaced; the pressure applied; and the second marble tile checked for levelness with the first laid marble tile. Should the second tile still be higher that the first tile, the leveling screw readjustments are to be repeated until such time as the levelness is achieved. If for example three unturns (or backing off turns, or unscrewing turns, or any other term that means turning a right hand screw in a counter clockwise direction) of the leveling screws produced the correct levelness of adjacent tile in combination with the particular worker's applied pressure, this minor adjustment should be made standard for laying and setting the entire marble floor. It is to be noted that even a relatively unskilled tile layer can readily adapt to making such minor adjustments to the leveling screws, in accordance with a reasonably close approximation to the amount of pressure previously applied, to achieve the desired effect of a second and subsequent tile being set level with each other; or in the alternative, only a minor amount of experimenting with how much pressure to apply and how far to back off the leveling screws 16 might be necessary to adapt the inventive procedure to such relatively unskilled workers in the field of tile laying and setting.

As the tiling of the floor progresses, the non levelness of the sub floor will eventually become a factor, ether more or less mud will be required. The inventive method provides simple procedures to account for the same. All that is required is adjusting the leveling screws either up or down while employing the method depicted in FIG. 2 and described above. In all probably, such adjustments will be minor and well within the scope of the skill of a tile setter after a very short time of applying the procedure by practicing or applying it on the job.

As described and illustrated, the inventive marble tile laying and setting method and its obvious variations eliminates the need to gauge and apply the proper amount of mud to assure the levelness of each marble tile relative to the adjacent marble tiles and to assure the overall levelness of the finished floor. Additionally, the inventive method provides the means and the ability to assure that grid lines of each adjacent laid and set marble tile and the grid lines of the finished flooring are straight and in accordance with the originally laid out grid lines. Moreover, the inventive method allows a less experienced marble tile setter to achieve the precision and quality of a more experienced marble tile setter in substantially less time required by the more experienced marble tile setter. Other advantages lie in its simplicity, its ability to result in a high quality finished floor, its ability to result in a finished marble floor that will be stable and subject to long time use, its ability to reduce costs, its ability to reduce job site time, its ability to be used by relatively unskilled workers, and its ability to be learned very quickly.

While the invention has been described, disclosed, illustrated and shown in certain terms or certain embodiments or modifications which it has or may assumed in practice, the scope of the invention is not intended to be nor should it be deemed to be limited thereby and such other modifications or embodiments as may be suggested by the teachings herein are particularly reserved especially as they fall within the breadth and scope of the drawings and description of the invention here appended.

I claim:

1. A method for laying a level natural stone tile floor comprising the steps of:

laying and leveling a first tile at a predetermined height above a floor;

positioning a four sided form with sides at right angles to each other with an open space therebetween, such that a first leveling side is abutted up against a first side of said first laid tile and such that leveling devices associated with said first leveling side are positioned over the first laid tile;

adjusting said overlying leveling devices such that a top edge of said abutting leveling side lies in a plane horizontal and parallel to the top surface of said first laid tile;

adjusting leveling devices associated with a second leveling side such that a top edge of said second leveling side lies in the same plane as said top edge of said first leveling side, said second leveling side being located opposite said first leveling side;

filling said open space within said form with mud to the top edges of said four sides, said mud comprising; a bottom layer of a bonding material, and a relatively thick layer of a base material;

removing the form; and laying a second tile with a layer of adhesive thereunder over the applied mud such that a top surface of said second tile is level with the top surface of said first laid tile.

2. The method of claim 1 including the steps of;

including at least one cross member between said opposite leveling sides with a top surface of said at least one cross member being in the same plane as the top edges of said opposite leveling sides.

3. The method of claim 1 including the steps of;

sizing said form such that the space between said four sides approximates that of a single tile.

4. The method of claim 1 including the steps of;

sizing said form such that the space between said four sides approximates that of at least two tiles.

5. The method of claim 1 including the steps of;

positioning said four sided form, such that said first leveling side is abutted up against a first side of said second laid tile and such that leveling devices associated with said first leveling side are positioned over the second laid tile;

adjusting said overlying leveling devices such that a top edge of said abutting leveling side lies in a plane horizontal and parallel to the top surface of said second laid tile, the plane of the top edge being removed from the plane of the top surface of the second laid tile a distance equal to the thickness of said tile;

adjusting leveling devices associated with the second and opposite leveling side such that a top edge of said second leveling side lies in the same plane as said top edge of said first leveling side;

filling said open space within said form with mud to the top edges of said four sides;

removing the form; and laying a third tile with a layer of adhesive thereunder over the applied mud and level with said second laid tile.

6. The method of claim 1 including the steps of;

positioning said four sided form, such that said first leveling side is abutted up against a second side of said first tile and such that leveling devices associated with said first leveling side are positioned over the second side of said a first laid tile ;

adjusting said overlying leveling devices such that a top edge of said abutting leveling side lies in a plane horizontal and parallel to the top surface of the second side of said first tile, the plane of the top edge being removed from the plane of the top surface of the second laid tile a distance equal to the thickness of said tile;

adjusting leveling devices associated with the second and opposite leveling side such that a top edge of said second leveling side lies in the same plane as said top edge of said first leveling side;

filling said open space within said form with mud to the top edges of said four sides; and, laying a third tile with a layer of adhesive thereunder over the applied mud and level with said first laid tile.

7. The method of claim 1 including the steps of;

determining the height at a particular location said first tile is to be laid above a floor to achieve a level floor having a plurality of tiles, said plurality of tiles extending in each direction relative to the sides of said first tile, said plurality of tiles substantially abutting each other.

8. The method of claim 1 including the steps of;

adjusting said overlying leveling devices such that a top edge of said abutting leveling side lies in a plane horizontal to the top surface of said first laid tile, the plane of the top edge being removed from the plane of the top surface of the second laid tile a distance equal to the thickness of said first laid tile.

9. The method of claim 1 including the steps of;

applying mud for said first tile, said mud comprising a bottom layer of a bonding material, and a relatively thick layer of a base material;

applying a layer of adhesive to the underside of the first tile; and laying said first tile on the mud and leveling said first tile by hand such that a top surface thereof lies in a substantially horizontal plane.

10. The method of claim 1 including the steps of;

repeating the steps of claim 1 and laying additional tiles to complete tiling of the floor.

* * * * *